United States Patent [19]

Wendt

[11] 3,955,330

[45] May 11, 1976

[54] SMOKE STOP FOR DOORS

[75] Inventor: Alan C. Wendt, Barrington, Ill.

[73] Assignee: United States Gypsum Company, Chicago, Ill.

[22] Filed: June 25, 1975

[21] Appl. No.: 590,365

[52] U.S. Cl. ..... 52/204; 52/1; 52/232; 52/741

[51] Int. Cl.[2] ..... E04H 9/00

[58] Field of Search ..... 52/1, 317, 232, 204, 52/741; 49/488, 504; 220/88 R, 88 A

[56] References Cited

UNITED STATES PATENTS

| | | | |
|---|---|---|---|
| 3,426,491 | 2/1969 | Gaeth et al. | 52/232 |
| 3,566,541 | 3/1971 | Coulter | 49/475 |

*Primary Examiner*—John E. Murtagh
*Assistant Examiner*—Carl D. Friedman
*Attorney, Agent, or Firm*—Donnie Rudd; Stanton T. Hadley; Samuel Kurlandsky

[57] ABSTRACT

A smoke stop for doors is disclosed. The smoke stop consists of a metal frame with a slot therein extending along substantially the entire length of the frame on the door side thereof; a continuous tube within the slot, the continuous tube having retarded decomposability at the kindling temperature of the door and the continuous tube having one or more fins running the entire length thereof and projecting outward on the door side of the frame; and an intumescent material completely enclosed within the continuous tube. When the door is closed and the frame and door are subjected to flames, the intumescent material expands causing the sealing of the space between the frame and the door and thereby providing a smoke stop between the door and the frame.

8 Claims, 3 Drawing Figures

SMOKE STOP FOR DOORS

BACKGROUND OF THE INVENTION

1. Field of the Invention

This invention relates to a smoke stop for doors.

2. Description of the Prior Art

It has long been a desire of the construction industry to provide a smoke stop between a closed door and the frame supporting the door. This smoke stop provides numerous advantages. If the smoke stop is effective as a smoke stop, it prevents smoke from passing through the door passage when a fire exists on one side of the door. This feature is extremely important from a health and safety standpoint. An additional advantage of a smoke stop is that it prevents passage of air into the room containing a flame thereby slowing the rate of spread of the flame.

Many attempts have been made to prepare a smoke stop for doors. The first such attempts made use of sealing materials between the frame and the door. These materials, upon closing of the door, were compressed between the door and frame thereby forming a seal therebetween. The disadvantage of this type of construction is that at all times the resilient material must contact the closed door, and the opening and closing of the door is thereby impeded. Additionally, wear on the door is caused by the consequent relative frictional movement upon opening and closing the door. If the edge of the door is a decorative surface, i.e., a highly finished painted or varnished section, then the constant contacting with the resilient material upon opening and closing of the door debases this highly decorative surface making it unsightly when the door remains open.

The use of intumescent materials to seal the space between a door and a frame is not novel. Many attempts have been made to utilize intumescent materials, i.e., materials that expand upon application of heat, to overcome the problems associated with the usage of the resilient facings and yet to provide an effective seal between the frame and the door upon contact thereof with a flame. These prior attempts, however, have all fallen short of the intended goal for one or more reasons. The basic failure of the systems has been due to the fact that most of the systems use an exposed intumescent material which upon sufficient heating melts and runs down the door thereby relinquishing its sealing properties. Other systems provide sealing with a combustible material which soons burns away and provides only a temporary solution before again presenting the problem of the material melting and destroying the seal. Still other systems have utilized slots within the frame with the slots containing an exposed intumescent material which upon heating expands and extrudes out of the slots into the space between the door and the frame. This system, however, fails for the same reasons mentioned above, namely, that the material soon melts and the seal becomes inoperative.

Prior issued patents demonstrate that the above-discussed systems have the shortcomings explained with relation thereto. In U.S. Pat. No. 3,774,345, a good example of the resilient contacting-type design is shown. This constant contact and rubbing with the door, however, tends to deface the door and thereby makes this type of system undesirable. Norwegian Pat. No. 66,400 is an early example of an intumescent simply laid upon the door frame itself for expansion upon heating. This system, however, has the consequent shortcomings of the material melting and then not providing an adequate seal between the door and the frame. Likewise, British Pat. No. 896,149 provides a similar system with an intumescent material on the face of the frame; however, one embodiment of this patent does provide an additional support for the intumescent material which prevents expansion in one direction. This system, however, does have the shortcoming of the intumescent material's being able to quickly melt and run out of the sealing area thereby causing a failure of the smoke stop system. British Pat. No. 896,150, provides still another system of placing an intumescent material within a slot in the frame, but this system merely directs the channeling of the intumescent material in a different direction and does not overcome the hereinabove discussed associated problems. Norwegian Pat. No. 104,072, is a system almost identical to the last mentioned British patent but enclosing the intumescent material in a rapidly decomposable tube which soon burns away thus leading to the same problems discussed in relation to the above-mentioned designs. U.S. Pat. No. 2,910,739, makes use of intumescent materials placed in a slot in the door, but, at best, the improvement therein is one in which wood encloses a portion of the intumescent material causing the obvious problem of the wood's rapidly burning away thereby exposing the intumescent material to flame which readily destroys it and the seal provided thereby. Danish Pat. No. 93,373, provides for an enclosed material, but the intumescent material can only expand through slots in the frame, and after extruding through the slots, the material again creates the problems discussed hereinbefore. U.S. Pat. No. 3,566,541, makes good use of a combination of the prior art systems providing for one exposed strip of intumescent material which has the problems discussed hereinbefore, but which also provides for an enclosed intumescent material sealed within a resilient contacting sealer. This design not only causes permanent contact and frictional wear on the door due to the continuous contact upon closing of the door, but as well, has the problems associated with a rapidly decomposable container for the intumescent material which, upon burning, provides the same problems discussed hereinbefore. Likewise, Danish Pat. No. 92,422, provides an intumescent material completely enclosed by a combustible material which upon the flame contacting the combustible material creates the same problems discussed hereinbefore. Finally, U.S. Pat. No. 3,426,491, makes good use of a sandwich-type system for sandwiching the intumescent material between metal and wood, but again, this system fails to prevent ready escape of the intumescent material creating the consequent failure of the seal upon heating.

In the design of this invention, the metal frame has a slot running the length thereof with a continuous tube of material having retarded decomposability completely enclosing an intumescent material, and the tube having fins thereon which, upon expansion of the intumescent upon application of heat, presses the fins into sealing contact with the door. It may thus be seen that the new and novel designs of this invention readily overcome the failing features associated with prior systems.

SUMMARY OF THE INVENTION

It is an object of this invention to provide a smoke stop for doors.

It is a further object of this invention to provide a smoke stop for doors which will not fail at the kindling temperature of a wood door.

It is an additional object of this invention to provide a combination door and frame which provides for a smoke stop therebetween upon heating of the door and the frame due to flame exposure.

It is an additional object of this invention to provide an assembled wall with a door and frame therein having a smoke stop provided in the door frame for sealing the space between the door and the frame when the wall is exposed to flames.

It is a further object of this invention to provide a method for making a door frame which upon exposure to flames provides a smoke stop between the frame and a door closed therein.

The objects of this invention are accomplished by a smoke stop for doors comprising: a metal frame with a slot therein extending along substantially the entire length of the frame on the door side thereof; a continuous tube within the slot, said continuous tube retarded decomposability at the kindling temperature of the door and said continuous tube having one or more fins running the entire length thereof and projecting outward on the door side of the frame; and an intumescent material completely enclosed within the continuous tube, whereby when the door is closed and the frame is subjected to by flames the intumescent material expands causing one or more of the fins on the tube to enter into engagement with the door along an edge thereof thereby providing a smoke stop between the door and the frame.

The objects of this invention are further accomplished by the combination comprising a door and a metal frame for holding the door, said metal frame having a slot therein extending along substantially the entire length of the frame on the door side thereof; a continuous tube within the slot, said continuous tube having retarded decomposability at the kindling temperature of the door and said continuous tube having one or more fins running the entire length thereof and projecting outward on the door side of the frame; and an intumescent material completely enclosed within the continuous tube, whereby when the door is closed and the frame is subjected to flames, the intumescent material expands causing one or more of the fins on the tube to enter into contact engagement with the door along an edge thereof thereby providing a smoke stop between the door and the frame.

The objects of this invention are additionally accomplished by the combination comprising an assembled wall with an opening therein, a metal door frame in the opening, and a door attached to the frame, said frame having a slot therein extending along substantially the entire length of the frame on the door side thereof; a continuous tube within the slot, said continuous tube having retarded decomposability at the kindling temperature of the door, and said continuous tube having one or more fins running the entire length thereof and projecting outward on the door side of the frame; and an intumescent material completely enclosed within the continuous tube, whereby when the door is closed and the frame is subjected to flames the intumescent material expands causing one or more of the fins on the tube to enter into contact engagement with the door along an edge thereof thereby providing a smoke stop between the door and the frame.

The objects of this invention are additionally accomplished in a door frame having an intumescent material disposed along the door side of the frame with said intumescent material expanding upon subjection of the frame to flames and with said expansion causing a seal between the frame and the door to prevent passage of smoke therebetween, by the improvement comprising: a metal door frame having a slot therein extending along substantially the entire length of the frame on the door side thereof; a continuous tube within the slot, said continuous tube having retarded decomposability at the kindling temperature of the door and said continuous tube having one or more fins running the entire length thereof and projecting outward on the door side of the frame; and an intumescent material completely enclosed within the continuous tube, whereby when the door is closed and the frame is subjected to flames the intumescent material expands causing one or more of the fins on the tube to enter into contact engagement with the door along an edge thereof thereby providing a smoke stop between the door and the frame.

Additionally, the objects of this invention are accomplished in a door frame having an intumescent material disposed along the door side of the frame with said intumescent material expanding upon subjection of the frame to flames and with said expansion causing a seal between the frame and the door to prevent passage of smoke therebetween, by the improvement comprising: a metal door frame having a slot therein extending along substantially the entire length of the frame on the door side thereof, an intumescent material within the slot; one or more fins made of material having retarded decomposability at the kindling temperature of the door, said fins completely containing the intumescent material within the slot and said fins being expandable to a line of contact with the door, whereby when the door is closed and the frame is subjected to flames the intumescent material expands causing one or more of the fins to enter into contact engagement with the door along an edge thereof thereby providing a smoke stop between the door and the frame.

The objects of this invention are further accomplished by a method of making a door frame which when subjected to flames acts in conjunction with a door to provide a smoke barrier, said method comprising: preparing a door frame with a slot extending along substantially the entire length thereof; and inserting within the slot a continuous tube containing an intumescent material, said continuous tube having retarded decomposability at the kindling temperature of the door, and said continuous tube having one or more fins running the length thereof and projecting outward on the door side of the frame.

The objects of this invention are still further accomplished by a method of making a door frame which when subjected to flames acts in conjunction with a door to provide a smoke barrier, said method comprising: preparing a door frame with a slot extending along substantially the entire length thereof; inserting an intumescent material within the slot; and sealing the intumescent material within the slot with one or more fins running the length of the slot, with said fins having retarded decomposability at the kindling temperature of the door.

The objects of this invention are still additionally accomplished by a method for providing a smoke barrier in an opening in a wall, said method comprising: inserting a door frame within the opening; and attaching a door to the door frame, said door frame having a slot therein extending along substantially the entire length of the frame on the door side thereof, an intumescent material within the slots and completely contained within the slot along the length of the slot by one or more fins projecting outward towards the door and made of a material having retarded decomposability at the kindling temperature of the door, whereby when the door is closed and subjected to flames, the intumescent material forces the fins outward in sealing contact with the door thereby providing a smoke barrier for the opening.

The smoke stop of this invention is provided by a metal frame having a slot therein running the length of the frame on the door side thereof with a continuous tube within the slot. The continuous tube is of a material having retarded decomposability at the kindling temperature of the door, and the slot has one or more fins running the entire length thereof and projecting outward on the door side of the frame. An intumescent material is completely enclosed within the continuous tube. When the door is closed and the frame is contacted by flames, the intumescent material expands causing one or more of the fins on the tube to contact the door along the edge thereof providing a smoke stop between the door and the frame. In the invention, the non-decomposable tube completely shields the intumescent material and encases it so that its expansion forces the fin on the tube outwardly against the door to provide the smoke stop. Since the tube does not rapidly decompose at the flame temperature, it contains the intumescent material long enough that it effectuates a seal between the frame and the door. This prevents a leak in the smoke stop. In other words, an effective seal is maintained until either the door or wall disintegrates due to the burning.

BRIEF DESCRIPTION OF THE DRAWINGS

This invention may be more fully described, but is not limited by the attached drawings wherein.

DESCRIPTION OF THE PREFERRED EMBODIMENTS

Figure 1:
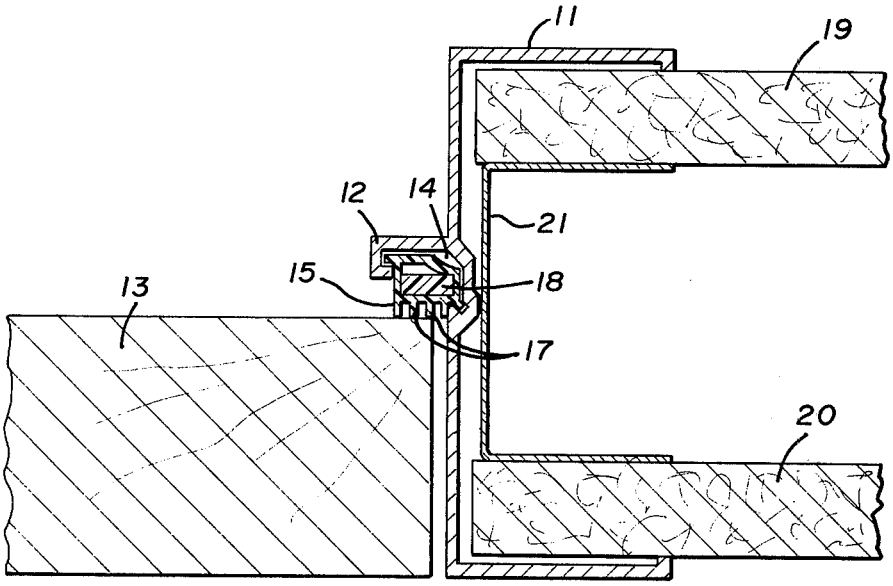
FIG. 1 is a top cross-sectional view of the smoke stop of this invention as attached to a wall and door.
Figure 2:
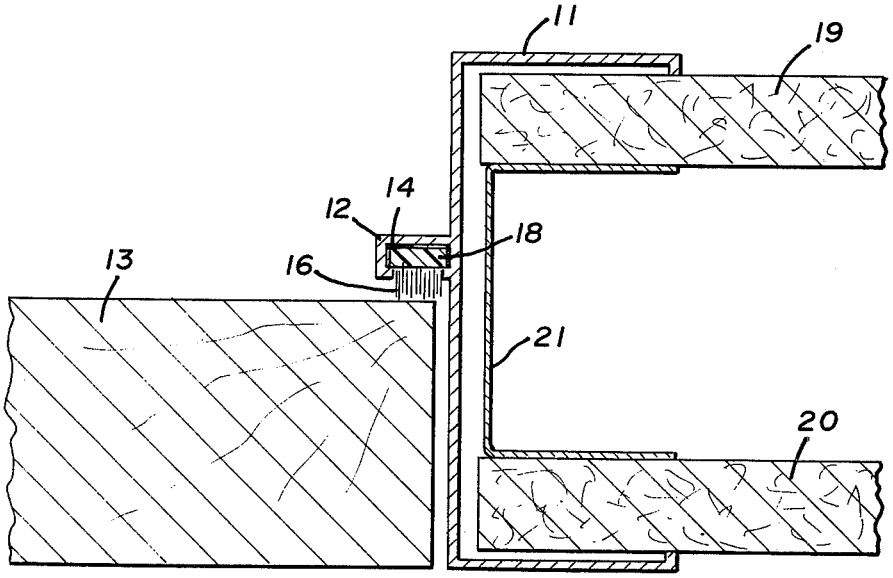
FIG. 2 is a top cross-sectional view of another embodiment of the smoke stop of this invention.
Figure 3:
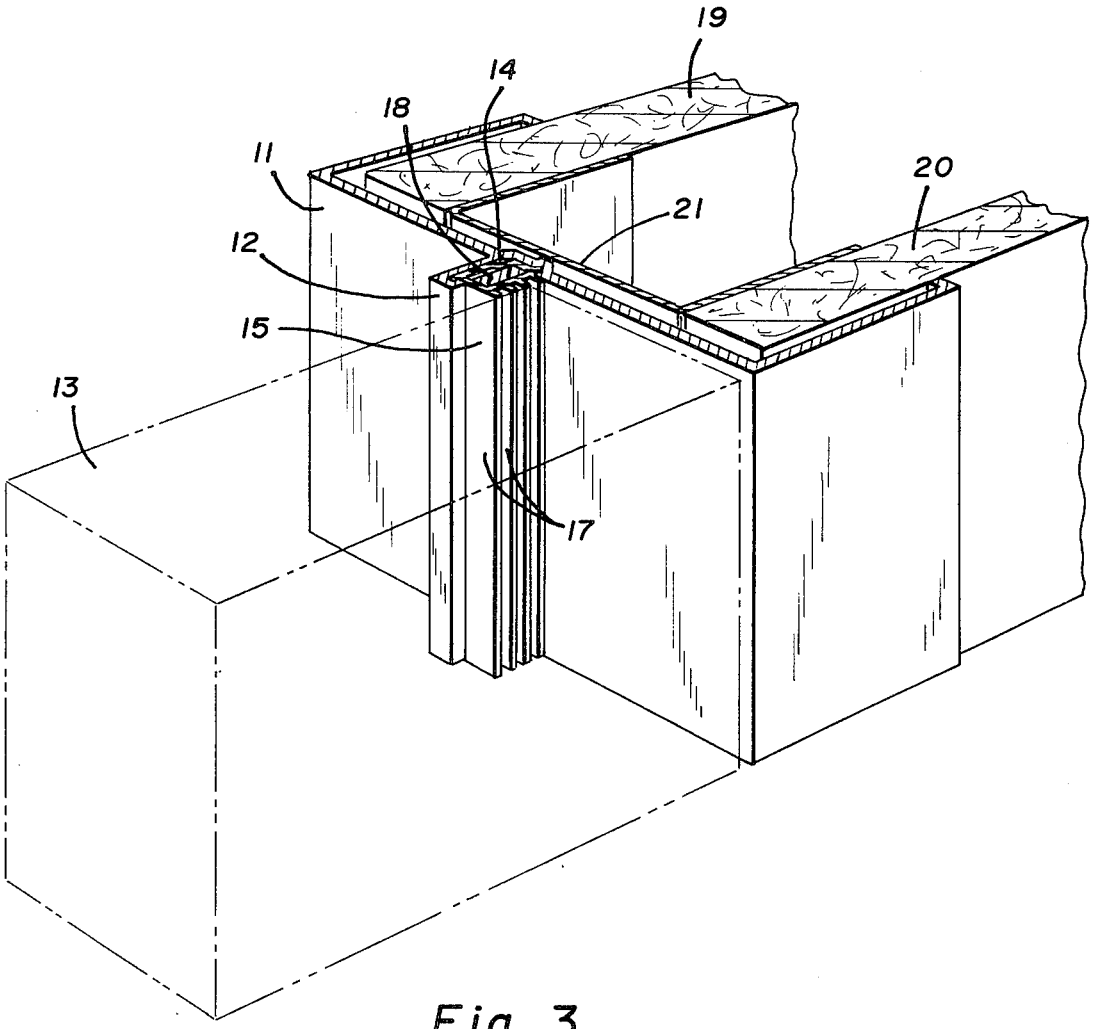
FIG. 3 is a cross-sectional perspective view of the smoke stop of this invention.

The preferred embodiments of this invention are more fully described by the attached drawings. Referring to FIGS. 1–3, a door frame 11 is shown having a door stop 12 extending outward therefrom to stop movement of the door 13 at the desired location. The door frame has a slot 14 therein containing a continuous tube 15, of material which is non-combustible at the kindling temperature of the remaining portions of the system. In FIG. 2, the continuous tube is shown as comprised of the metal door frame 12 with inserted fins 16 which engage the sides of the slot 14 to provide a continuously locked tube of non-combustible material. In this embodiment, the fins 16 are made of non-combustible material. In FIGS. 1 and 3, the non-combustible material shown has fins 17 thereon for contacting the door. In FIG. 2, the fins 16 shown are provided as part of the tube itself. Within the continuous tube 15 is placed an intumescent material 18 which expands upon exposure to heat. The intumescent material may be that used in any of the previously described systems as well as such material as is described in U.S. Pat. Nos. 2,912,393, 2,632,743, and 3,365,322 and includes additionally such materials as aluminum chloride added to incompletely condensed phenol-formaldehyde condensates; ammonium salts, along with dextrin or urea, with a filler, ammonium phosphate, sugar, gum arabic and further including other additives well known to the intumescent art such as water, glass fiber, alkali metal silicate and the many other systems known as intumescent material, and other such systems which have the property of being readily expandable upon heat to the extent that they force outward the fins on the tube so that they will contact the door to provide a smoke stop between the door and frame. In other words, any of the well known intumescent material are acceptable providing that upon application of the heat range of normal flame temperatures within a room, they readily expand to force the fins outward in contact with the door. It has been found to be particularly acceptable to use various plastic materials which have entrained or entrapped therein small particles of water and which upon heat expand forcing the plastic itself to expand and force outward the fins to the extent necessary to contact the door. Any material of reduced or retarded decomposability may be used for the continuous tube. It is preferable that such material be somewhat deformable or resilient in order to accommodate the design requirements of the system.

Although, any wall system is acceptable for use in this invention, the preferred embodiments include a particularly desirable type of system wherein the door frame engages wall panels 19 and 20 which are additionally secured by stud 21.

In the embodiment shown in FIGS. 1–3, the expansion of the intumescent material caused by heating of the frame forces the fins outward in contact with the door providing a seal between the door and the frame. Since the intumescent material is completely enclosed within the slot, its expansion merely forces the fins against the door but does not allow the intumescent material to escape thereby destroying the seal. Even if extreme heat causes extreme pressure within the intumescent material, the expansion will still provide a smoke stop by forcing non-combustible material into the seal which would remain in spite of a leakage of the intumescent itself.

It may be seen that this new and novel invention provides a new and unique system which has heretofore been unknown. The system readily and inexpensively overcomes all of the deficiencies of prior systems and provides an effective smoke stop between a door and a frame upon exposure of the door and the frame to the heat of a flame. This new and novel design provides heretofore unknown safety features and significantly advances construction systems which provide for smoke stops between doors and door frames.

Having fully described this new and unique invention, the following is claimed:

1. A smoke stop for doors comprising: a metal frame with a slot therein extending along substantially the entire length of the frame on the door side thereof; a continuous tube disposed within the slot, said continuous tube having retarded decomposability at the kindling temperature of the door and said continuous tube having one or more fins running the entire length thereof and projecting outward on the door side of the frame; and an intumescent material completely enclosed within the continuous tube, whereby when the door is closed and the frame is subjected to flames, the intumescent material expands causing one or more of the fins on the tube to enter into contact engagement with the door along an edge thereof thereby providing a smoke stop between the door and the frame.

2. In combination, a door and a metal frame for holding the door, said metal frame having a slot therein extending along substantially the entire length of the frame on the door side thereof; a continuous tube within the slot, said continuous tube having retarded decomposability at the kindling temperature of the door and said continuous tube having one or more fins running the entire length thereof and projecting outward on the door side of the frame; and an intumescent material completely enclosed within the continuous tube, whereby when the door is closed and the frame is subjected to flames, the intumescent material expands causing one or more of the fins on the tube to enter into contact engagement with the door along an edge thereof thereby providing a smoke stop between the door and the frame.

3. In combination, an assembled wall with an opening therein, a metal door frame in the opening, and a door attached to the frame, said frame having a slot therein extending along substantially the entire length of the frame on the door side thereof; a continuous tube within the slot, said continuous tube having retarded decomposability at the kindling temperature of the door, and said continuous tube having one or more fins running the entire length thereof and projecting outward on the door side of the frame; and an intumescent material completely enclosed within the continuous tube, whereby when the door is closed and the frame is subjected to flames the intumescent material expands causing one or more of the fins on the tube to enter into contact engagement with the door along an edge thereof thereby providing a smoke stop between the door and the frame.

4. In a door frame having an intumescent material disposed along the door side of the frame with said intumescent material expanding upon subjection of the frame to flames and with said expansion causing a seal between the frame and the door to prevent passage of smoke therebetween, the improvement comprising: a metal door frame having a slot therein extending along substantially the entire length of the frame on the door side thereof; a continuous tube within the slot, said continuous tube having retarded decomposability at the kindling temperature of the door and said continuous tube having one or more fins running the entire length thereof and projecting outward on the door side of the frame; and an intumescent material completely enclosed within the continuous tube, whereby when the door is closed and the frame is contacted by flames the intumescent material expands causing one or more of the fins on the tube to enter into contact engagement with the door along an edge thereof thereby providing a smoke stop between the door and the frame.

5. In a door frame having an intumescent material disposed along the door side of the frame with said intumescent material expanding upon subjection of the frame to flames and with said expansion causing a seal between the frame and the door to prevent passage of smoke therebetween, the improvement comprising: a metal door frame having a slot therein extending along substantially the entire length of the frame on the door side thereof, an intumescent material within the slot; one or more fins made of material having retarded decomposability at the kindling temperature of the door, said fins completely containing the intumescent material within the slot and said fins being expandable to a line of contact with the door, whereby when the door is closed and the frame is subjected to flames the intumescent material expands causing one or more of the fins to enter into contact engagement with the door along an edge thereof thereby providing a smoke stop between the door and the frame.

6. A method of making a door frame which when subjected to flames acts in conjunction with a door to provide a smoke barrier, said method comprising: preparing a door frame with a slot extending along substantially the entire length thereof; and inserting within the slot a continuous tube containing an intumescent material, said continuous tube having retarded decomposability at the kindling temperature of the door, and said continuous tube having one or more fins running the length thereof and projecting outward on the door side of the frame.

7. A method of making a door frame which when subjected to flames acts in conjunction with a door to provide a smoke barrier, said method comprising: preparing a door frame with a slot running the entire length thereof; inserting an intumescent material within the slot; and sealing the intumescent material within the slot with one or more fins extending along substantially the entire length of the slot, with said fins having retarded decomposability at the kindling temperature of the door.

8. A method for providing a smoke barrier in an opening in a wall, said method comprising: inserting a door frame within the opening; and attaching a door to the door frame, said door frame having a slot therein extending along substantially the entire length of the frame on the door side thereof, an intumescent material within the slots and completely contained within the slot along the length of the slot by one or more fins projecting outward towards the door and made of a material having retarded decomposability at the kindling temperature of the door, whereby when the door is closed and subjected to flames, the intumescent material forces the fins outward in sealing contact with the door thereby providing a smoke barrier for the opening.

* * * * *